US005176199A

United States Patent [19]

Czolkoss

[11] Patent Number: 5,176,199

[45] Date of Patent: Jan. 5, 1993

[54] METHOD FOR MEASURING THE CLEANING EFFECTIVENESS OF CLEANING BODIES ON HEAT EXCHANGERS

[75] Inventor: Wolfgang Czolkoss, Dortmund, Fed. Rep. of Germany

[73] Assignee: Taprogge GmbH, Fed. Rep. of Germany

[21] Appl. No.: 760,478

[22] Filed: Sep. 16, 1991

[30] Foreign Application Priority Data

Sep. 14, 1990 [DE] Fed. Rep. of Germany ..... 4029196

[51] Int. Cl.[5] ..... F28G 1/12

[52] U.S. Cl. ..... 165/1; 165/11.1; 165/95

[58] Field of Search ..... 165/1, 11.1, 95; 73/865.8, 866.5; 374/45

[56] References Cited

U.S. PATENT DOCUMENTS

| | | | |
|---|---|---|---|
| 4,426,917 | 10/1984 | Otake et al. | 165/1 |
| 4,686,853 | 8/1987 | Sugam et al. | 73/61.2 |
| 4,762,168 | 8/1988 | Kawabe et al. | 165/11.1 |
| 5,083,606 | 1/1992 | Brown et al. | 165/11.1 |

FOREIGN PATENT DOCUMENTS

| | | |
|---|---|---|
| 3106530 | 9/1982 | Fed. Rep. of Germany . |
| 1095476 | 12/1963 | United Kingdom . |

OTHER PUBLICATIONS

Beck, M. S. and Plaskowsky, A., Inferential Measurement of Fluid Flow from the Cross Correlation of Temperature Fluctuations in the System, Electronics Letters, vol. 3, Nr. 4, Apr. 1967, 167–171.

Mesch, F., Daucher, H. H. and Fritsche, R., Geschwindigkeitsmessung mit Korrelationsverfahren, messtechnik Jul. 1971, 152–157 und messtechnik Aug. 1971, 163–168.

Bentley, P. G. and Dawson, D. G., Fluid Flow Measurement by Transit Time Analysis of Temperature Fluctuations, Trans. Soc. Instr. Technology, Sep. 1966, 183–193.

Schöltzel, P., Einführung in die Korrelationsmess technik, Teil 1+2, Elecktronik, Heft 2, 1971, 39–42 und Heft 3, 1971, 93–96.

Bonfig, K. W., und U. Kuipers: Anwendung der Korrelation als modernes Mess prinzip zur Durchfluss messung nach dem Laufzeitverfahren. Technische Mitteilungen 79 (1986) Heft 9.

Massen, R., Berührungslose Geschwindigkeitsmessung durch Korrelation ntz (1980) Heft 5, S. 300–304.

*Primary Examiner*—Allen J. Flanigan

*Attorney, Agent, or Firm*—Banner, Birch, McKie & Beckett

[57] ABSTRACT

The invention concerns a method for measuring the cleaning effectiveness of cleaning bodies (20) on heat exchangers having a bunch of tubes (16). Further, a plant is proposed in which the heat transfer from steam into cooling water through the walls of the condenser tubes is measured. The measurement is carried out with the aid of an inertialess temperature sensor (15) so that, by highly sensitive measuring of the temperature sequence of a certain control volume, the cleaning effect of the cleaning bodies can be derived.

15 Claims, 3 Drawing Sheets

METHOD FOR MEASURING THE CLEANING EFFECTIVENESS OF CLEANING BODIES ON HEAT EXCHANGERS

The invention concerns a method for monitoring the cleaning effectiveness of cleaning bodies which are fed into the water inlet manifold of a heat exchanger having a bunch of tubes, for cleaning the tubes. The cleaning bodies are forced by water flow through the individual tubes, are collected in the water outlet manifold and are then, via a lock for a possible check, fed back again into the water inlet manifold. A cleaning body to be monitored is passed through a tube containing water, the tube being equipped to monitor the cleaning effectiveness. The invention concerns further a method for monitoring the cleaning effectiveness of cleaning bodies in an enlarged sense, namely by monitoring the heat transfer during condensation from steam into the cooling water in one or several cooling water tubes of the condenser and the invention proposes a corresponding device and or plant therefore.

The cleaning of the cleaning bodies is based on the effect that they are larger than the internal diameter of the scoured tubes. For the monitoring of the effectiveness of cleaning bodies there are several proposals. One is disclosed in the German patent specification 3316202. The cleaning bodies being circulated are guided through a bypass according to a random selection in which a measuring tube is positioned, the displacement of which in the travelling direction of the cleaning body to be monitored is measured as a friction force. The measuring tube is a few centimeters long and the cleaning body is forced through it by the cooling water during the measuring.

In this kind of monitoring the effectiveness of the cleaning bodies for cleaning condensers is in principle satisfactory. However, the necessary equipment is rather complex so that corresponding measuring devices are expensive. A further disadvantage is the shortness of the measuring tube. The cleaning body does not always pass the tube in its relevant position, when it is already slightly used or no longer has the ideal spherical shape but more the shape of a barrel. The entrance of a ball into a heat exchanger tube takes place in such a way that the ball, immediately after the entrance, will automatically take the position of the lowest resistance, and thus the worst cleaning effect. In dependence of the incidental position at the entrance into the measuring tube either a higher or a lower friction force during the passage is signalled so that there is a residual uncertainty whether the cleaning bodies really have the suggested cleaning effectiveness. There is a possible inconsistency between the monitoring and the actual cleaning of cleaning bodies, which are no longer ideally ball-shaped.

It is the object of the invention to improve a method of the aforementioned kind so that the residual uncertainty is also excluded and the necessary equipment simplified.

For meeting this object the invention proposes that the water in the interior of the tube is warmed by a heat source acting through the tube wall, and that at a predetermined position along the tube the temperature sequence is measured and computed when a cleaning body passes this position.

It has surprisingly been found that in the smallest zone ahead of and behind the cleaning body there are temperature variations which depend from the friction force of the cleaning body, and thus from the force to remove impurities on the inside of the corresponding tube when the cleaning body, driven by the flowing water, is pushed along and while the tube is heated from outside. The pressure drop which causes the drive of the cleaning body through the tube is responsible for the water being squeezed by the cleaning body through the gap between the body and the internal wall of the tube, an effect which leads, immediately downstream of the cleaning body by the so-called jet-effect, to strong turbulence of the boundary layer of the water column within the tube. Immediately upstream of the cleaning body, a calming down of the flow can be detected so that less heat from the tube transfers into the fluid, the fluid being thus slightly colder than the fluid under a very turbulent flow.

As a result of these facts a marked temperature jump during the passage of a cleaning body having a high friction force, and thus a high pressure drop, between the area downstream and upstream of the cleaning body is measured at the measuring position, i.e. a marked drop at the actual moment of passing of the body to a value which lies under the normal water temperature, and, afterwards, a temperature rise to the normal level. The temperature sequence is thus characterized by a rise, a sharp drop and a return to substantially the initial value within less than half a second.

A reliable monitoring, according to which the cleaning of the heat exchanger tubes can successfully be operated, needs a judgement of the described temperature sequence on the basis of experience. For the calibrating of the plant on which the monitoring is operated, it is advisable first to pass through the tube cleaning bodies the pressure for scouring, diameter and roundness of which are known. By storing a multitude of corresponding cycles, the amount of temperature variations which represents the ideal state of the cleaning bodies can be determined. Then, cleaning bodies having a smaller diameter but also an ideal ball-shape can be used, whereby the smaller diameter is achieved by grinding down bigger balls with the aid of corresponding machines. Again, by storing corresponding measured values a spectrum of temperature variations can be fixed which is representative for the used form of the cleaning bodies. When the diameter of the cleaning bodies corresponds to the internal diameter of the tube there is no real drive by a pressure drop but the cleaning body just floats through the tube without any applied forces. In such a limiting case, there is virtually no discernable temperature variation. Since there is also no cleaning effect, the operational limit where the cleaning bodies are no longer used is kept well from the zero effect limit. It is to be emphasised that the above described calibration of a plant is necessary only once, not even during each installation of the plant but once and for all before taking into use the very first plant of this kind. The given limits and spectra are thus fixed from this moment.

Different from the described kind of relationship between the measured temperature sequence and the cleaning effectiveness, a real and working plant can be used which is in a new state. Then, cleaning bodies are used which have been specified, the diameter of which is thus known and the roundness of which is guaranteed. On the basis of the measured temperature sequences a relation to the friction force, i.e. the cleaning effect, can be established with cleaned tubes and new cleaning bodies. Again, with the aid of cleaning bodies having smaller diameters which still provide a considerable friction force the change of the temperature sequences can be monitored corresponding to a situation of worn cleaning bodies within a new, i.e. cleaned tube. This kind of calibration of a corresponding plant has the advantage that all parameters which participate in the temperature variation are also incorporated. These include the temperature level, the length of the corresponding heat exchanger tube and the amount of heat which is taken up during the passage through a heat exchanger tube.

The result of the cleaning effectiveness of the cleaning bodies according to the method of the invention not only comprises the diameter but also the hardness of each cleaning body, which, for instance, decreases in the presence of hydrocarbons in a cooling water while the diameter increases due to swelling. The cleaning effect of corresponding cleaning bodies is not very good, despite the increased diameter because of a lower friction force, so that also the pressure drop over the cleaning body during the transport through the tube is smaller. Accordingly, the described jet-effect at the contact zone between the cleaning body and the internal wall of the tube is smaller which leads to a correspondingly smaller temperature drop. The method according to the invention allows also the monitoring of defective cleaning bodies. Indirectly, it is always the friction force which is measured and which is simply and solely decisive for the cleaning effectiveness.

It is especially useful to carry out the measuring directly on a heat exchanger tube of which all conditions for carrying out a measuring according to the invention are fulfilled. The position at which the measuring takes place is preferably at the end of the tube where there exists a good accessibility for the installation of a temperature sensor and its wires and any signal transmitter. The only condition which has to be fulfilled is the nearly inertialess measuring of a temperature variation during the passage of a cleaning body as well as corresponding processing having a precision which allows precise discrimination of less than a tenth of a degree centigrade.

Of course, the monitoring can be carried out several times on a heat exchanger so that at the same time information can be obtained as to how the cleaning balls are distributed over the tube bunch of the heat exchanger or within one pass of a multi-pass heat exchanger. Each passage of a cleaning body which still has a detectable cleaning effect, at the same time, is also a signal that a cleaning body is present and can be used for corresponding information. Since the necessary equipment is very simple, ten or more positions for temperature measurement can be installed, whereby, at the same time, the effect of a failure of one measuring position is small since the others are sufficient for successfully continuing the monitoring of the cleaning effectiveness.

The sensitivity due to the sophisticated processing of the signals during the passage of a cleaning body and the near inertialess measurement enables a further application, namely the measuring of the flow velocity of the cooling water within a heat exchanger tube with the aid of the installed temperature sensor at the exit of the heat exchanger tube, provided that an identical measuring arrangement is present at the tube entrance, sufficiently distinctive temperature changes prevail at the place of the entry of the cooling water and a corresponding computing unit is provided for the re-identification of the distinctive temperature change profile present at the tube entrance by a comparison with the temperature change profile measured at the tube exit. It is possible to re-identify sufficiently distinctive temperature changes so that they can be used for fixing a time which passes from the passage of the cooling water at the tube entrance to the passage of the cooling water at the tube exit. By observing the length of the tube the flow velocity can be calculated. It is emphasized that the re-identification is successful even though the cooling water is warmed within the tube. It has surprisingly been found that despite the suggested disturbing by the heat take-up sufficiently distinctive temperature changes are stable on the way through the heat exchanger tube in order to re-identify them at the end of the tube when they have been taken up at the tube entrance.

The knowledge of the flow velocity of the cooling water within the tube can be used twice. On the one hand, by additionally measuring the pressure drop over the tube bunch of a heat exchanger the roughness of the surface of the interior tube wall can be computed, since the tube friction coefficient depends on the roughness besides the known dimensions of the tube. The roughness gives a hint as to depositions, especially for impurifications by chemical effects or for corrosion. On the other hand, the heat transfer from the steam into the cooling water of a condenser can be computed when the steam temperature is known. The steam temperature can be very easily measured by blocking a neighbouring tube and by installing a temperature measuring unit in the interior of this blocked tube. This kind of measuring of the steam temperature is known per se. A further condition is that not only the temperature profile between the tube entrance and the tube exit of the corresponding condenser tube is re-identified, but also that the real temperature is fault freely known. In connection with the flow volume of the cooling water derived by the measuring of the velocity and the detected temperature changes the heat transfer coefficient k can be computed in the usual way.

Sufficiently distinctive temperature changes, i.e. a sufficiently distinctive temperature profile, is then present when it is re-identifiable. Such temperature profiles are for instance generated in the second way of a multi-way heat exchanger. Due to the different heating in different areas of the tube bunch there are different cooling water temperatures at the tube exits of the first way which are not yet completely levelled at the entrance of the second way owing to an insufficient mixing. On the contrary, there are differences of approximately 2° C. within one second which is sufficient for a re-identification when the temperature measuring is carried out according to the invention, i.e. highly sensitive and inertialess, and when the computing facility allows the re-identification for instance by a cross-correlation.

When the same monitoring method for the flow velocity through a tube bunch heat exchanger is carried out in the first pass or in a one pass heat exchanger a distinctive temperature profile has to be created artificially which can be carried out with simple means. The feeding of steam, of warmed or cooled water close to the entrance of a tube having a thermo-element at the entrance and the exit is sufficient, especially where water is used which is warmed by the heat exchanger, because this heat is present without an additional use of energy. Otherwise, there are other possibilities for creating a warm or cold part-stream within the cooling water stream which are technically applicable and usable. Thus the contents of heat exchanger tubes can be directed into the cooling water entrance of the heat exchanger, and there can be used heat exchanger devices within the cooling water entrance, whereby especially the tube plate of the cooling water entrance can be used as a heat giving surface; the tube plate is basically warmer than the surroundings owing to the contact on its rear side by the steam to be condensed or by the medium to be cooled. Also, the tube or the tubes can be used for feeding warm or cold water through which the cleaning bodies are fed into the cooling water entrance. It is only important that there is a sufficiently distinctive temperature variation in the vicinity of that tube which is equipped for the measuring of the flow velocity.

Of course, the cleaning effectiveness of the cleaning bodies and the flow velocity can be measured on one and the same tube. If a temperature drop indicates the passage of a cleaning body the signal should be rejected for the flow velocity, because a cleaning ball passing through a condenser tube lowers the flow velocity. If no temperature drop is obtained at the tube end the signal for the flow velocity can be used.

Embodiments of the invention which are shown in the drawings are explained in greater detail hereinafter. In the drawings.

Figure 1:
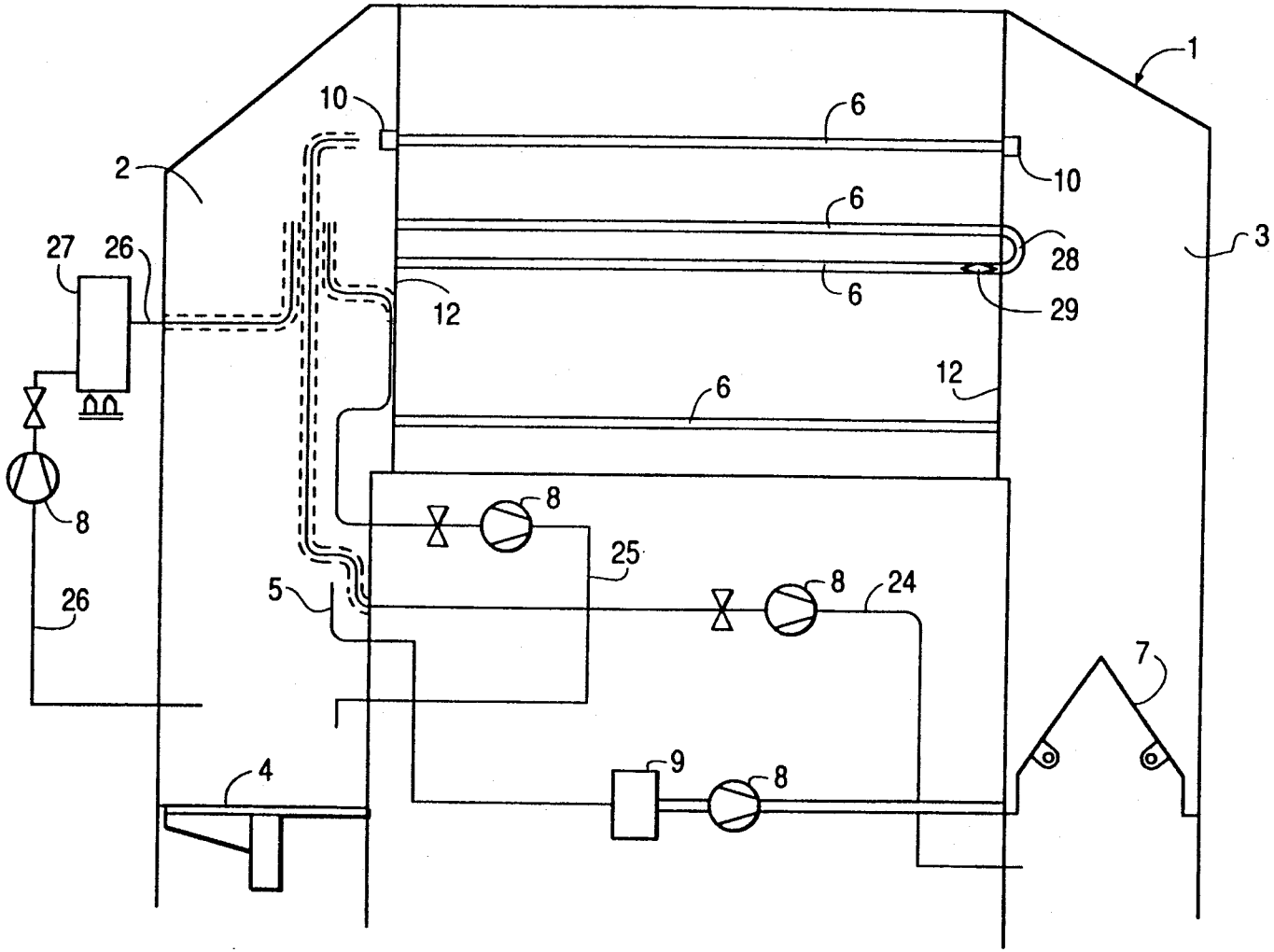
FIG. 1 is a diagrammatic view of a steam condenser with a plant according to the invention.

In FIG. 1 a steam condenser 1 is diagrammatically shown but the steam path is not shown. Through a cooling water inlet manifold 2 cooling water is pumped into condenser tubes 6 and leaves the condenser 1 via a cooling water outlet manifold 3. At the cooling water inlet manifold entrance there is a back flow filter 4 in order to retain coarse impurities. At the exit of the cooling water outlet manifold 3 there is a retainer 7, by which cleaning bodies 20 (FIG. 2), which are circulated through the single condenser tubes 6 in order to clean them, are caught. There is a conduit 5 in the cooling water inlet manifold 2 through which the cleaning bodies 20 are fed into the cooling water. The conduit 5 is supplied by a lock 9 in which the cooling bodies are caught, sorted, replenished, inspected, measured or treated in any other way. A pump 8 provides the progress of the cleaning bodies into the lock 9 and through the lock 9.

The invention is concerned with the cleaning effectiveness of the cleaning bodies 20 which depends in the first place on their oversize and hardness. Further, the invention is concerned with the monitoring of the cleaning effect by measuring the heat transfer from the steam into the cooling water, whereby the cleaning effectiveness can be checked, namely by a check of the actual cleanliness factor of the gauged condenser tube 6. Further, by measuring single, predetermined condenser tubes, a very early knowledge of incipient fouling or corrosion of the tubes 6 is possible.

Figure 2:
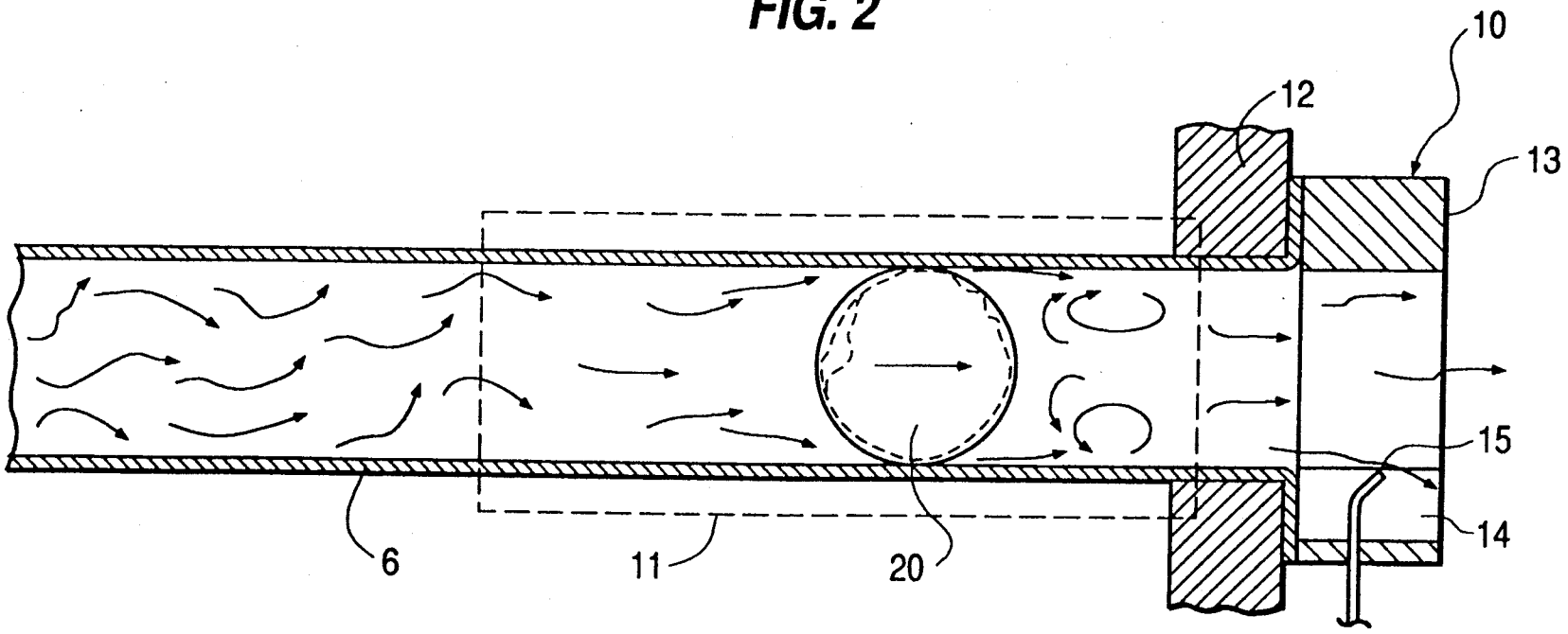
FIG. 2 is a cross-sectional view through the area of a condenser tube end which carries a temperature measuring unit according to the invention.

In FIG. 2 the outlet side of a condenser tube 6 is shown which is provided with a measuring device set 10. In detail, it comprises a ring 13, which is centred with the condenser tube 6 and fixed onto the outside of a tube plate 12 of the condenser 1. At the lower side there is a slot 14 in which is supported a temperature sensor 15.

The temperature sensor 15 must react very quickly. A thermo-element with a shroud which has an outer diameter of 0.5 mm, has proved to be successful. Admittedly, even smaller thermo-elements 15, are available, but a certain robustness is necessary since occasionally an impurity may pass through the condenser tube 6 and might hit the thermo-element. Such a load the thermo-element 15 should withstand without damage.

In FIG. 2 the numeral 11 defines a check volume which travels together with the cleaning body 20 through the tube 6. Attention is drawn to the fact that the cleaning bodies 20 have a form different from the ideal ball-shape, resembling more or less a barrel, and take, after entrance into the condenser tube 6, such a position that the cleaning effect is the smallest, and thus the smallest resistance prevails against the condenser tube 6. This position also creates the smallest friction forces and thus the worst cleaning effect. Since according to a special embodiment of the invention a condenser tube 6 is one component of the measuring device and the measuring of the temperature profile during the passage of a cleaning body 20 takes place at the end of the condenser tube 6, it is reasonably certain that in the case of measuring at this position, the smallest friction force of the cleaning body 20 prevails. Compared to measuring devices in which the friction force is directly measured, the invention guarantees that always the worst cleaning situation is used for the measuring which is the only relevant value for the cleaning effectiveness of the cleaning bodies, because the real cleaning takes place over the largest section of the condenser tube with the lowest force for separating impurities which automatically is effective after a few centimetres. In other words, if the measuring tube for measuring the friction force is for instance 10 cm long, in most cases the cleaning body has not yet taken up its "most comfortable" position but is still on the way to reaching this position. If however, as with the invention, a measuring tube is used which is a condenser tube of several metres in length, this position automatically taken up of the lowest friction force is virtually always taken up by the time the cleaning body reaches the end of the condenser tube.

Figure 3:
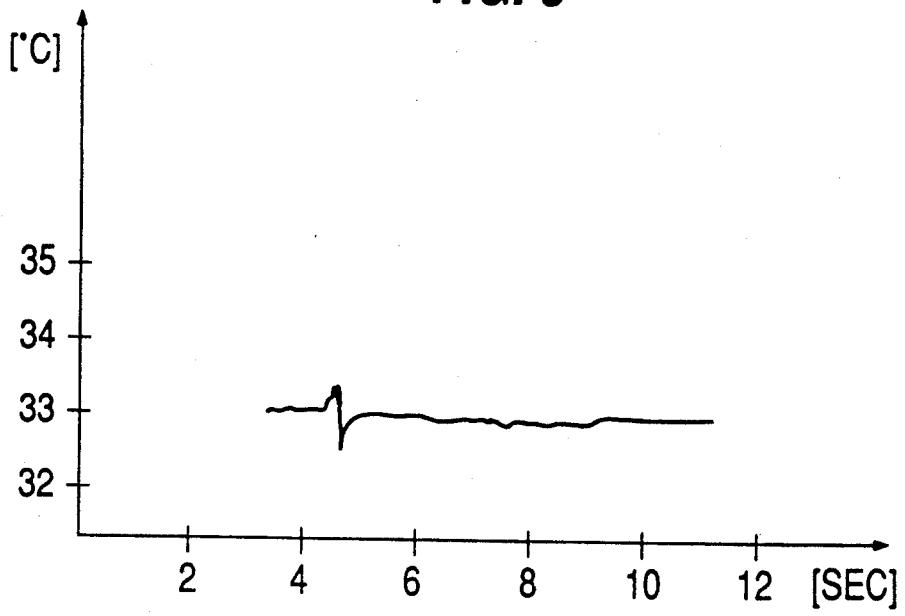
FIG. 3 is a graphic representation showing a temperature sequence during the passage of a cleaning body of a place equipped according to the invention; and, FIG. 4 shows two graphs representing the re-identification of a sufficiently distinctive temperature profile between the tube entrance and the tube exit of a condenser.

In FIG. 3 a print-out is shown which shows the change of temperature with the time as measured by the thermo-element 15 during the passage of a cleaning body 20. There is clearly a rise, a steep drop by approximately double the value of the rise and a further slightly slower rise to the original temperature level, within a period of time of less than half a second. The temperature sequence shows the conditions within the check volume 21, which prevail during the flow through the condenser tube 6, and which are detected at the end of the tube within the ring 13 with the aid of the thermo-element 15. It has already been explained that owing to the jet-effect there is a zone of strong vortices downstream of the cleaning body 20 and thus a very good heat transfer from the warm tube wall into the cleaning water, while upstream of the cleaning body 20 there is a more calm situation, whereby in this section of the flow less heat is transferred from the tube wall into the cooling water.

The thermo-element 15 having a shroud is connected to a computing unit in which, on the base of the temperature sequence shown in FIG. 3, the cleaning effect of the cleaning body is determined. Further, the cleaning body circulation of the whole plant can be checked by applying statistic methods and thus determine the number of cleaning bodies which are participating in the cleaning and not tucked away in for instance zones of stagnation. The computed number is comparable with the number of the cleaning bodies put into the lock 9. Under the condition that measuring devices 10 are randomly distributed over the tube plate 12 of the condenser and fitted to corresponding condenser tubes 6 the cleaning body distribution of the whole tube bunch of the condenser 1 can be checked.

On the basis of the measured temperature sequence in the moment of a cleaning body passing the tube end, the cleaning intensity with which the whole condenser is cleaned, can be judged. The cleaning intensity is determined by the cleaning effect of the cleaning bodies circulating and their number, i.e. the number of passes per time unit through the heat exchanger tubes. Depending on the intensity the cleaning intervals are extended or shortened, or fresh cleaning bodies, which have a high cleaning effect, are brought into circulation.

All relevant values can be shown on a monitor or can be printed with the aid of a plotter or can be transferred to a different place, for instance into the control room of a power plant. In dependence of the amount of automatization the catching of worn cleaning bodies and the supply of new cleaning bodies can be carried out manually, semi-automatically or fully automatically. It is only important that a deterioration of the cleaning effectiveness is determined very early, and that countermeasures can be initiated.

The measuring device 10 shown in FIG. 2 and explained hereinbefore can be fitted as an identical unit additionally in the cooling water inlet manifold 2 (FIG. 1) close to the tube plate, as diagrammatically shown in FIG. 1 at the uppermost illustrated condenser tube 6. In this way, there is the possibility of measuring the water entry temperature and the water exit temperature of the cooling water travelling through the corresponding condenser tube 6. With this device the amount of heat which enters into the cooling water during a passage through the condenser tube can be determined if the mass flow of the cooling water is known, i.e. the product of the cross-sectional surface, the travelling velocity and the density. While the density, depending on the temperature, is known and the cross-sectional surface of the condenser tube is fixed by the design and thus also known, the travelling velocities have to be measured. This can be made with corresponding measuring units.

According to a further proposal of the invention, the travelling velocity is measured by allowing cooling water to enter into the condenser tube 6, the condenser tube 6 carrying a measuring device 10 at each of the front and rear end. It has been found that a re-identification of a temperature profile at the tube end is possible if the cooling water has a temperature profile when entering the condenser tube which is sufficiently distinctive. This is true even though the cooling water has taken up heat out of the steam and has been strongly mixed. A sufficiently distinctive temperature profile can be generated in different ways.

Figure 4:
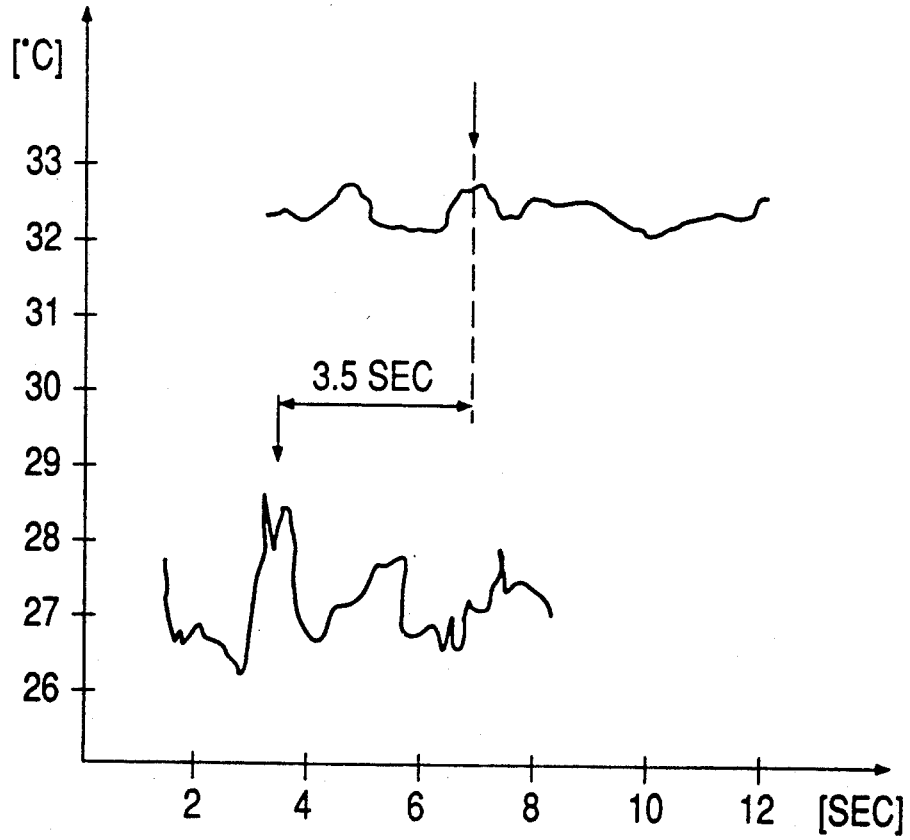

In FIG. 4 two measurement print-outs are shown which show the temperature sequence at the tube entrance (lower line) and at the tube exit (upper line), respectively, within a certain time interval. The sufficiently distinctive temperature profile at the entrance to the condenser tube 6 stems from the flow through a first condenser pass without additional means. The cooling water exiting from the first condenser stage has consequently different zones which have temperature differences of several degrees centigrade. It has surprisingly been found that a temperature profile present at the entrance of a tube in the second pass of a condenser, despite a strong mixing and despite the take-up of heat in the condenser tube 6 by the cooling water, is re-identifiable within sufficient safety margins at the end of the tube. The sections marked with two arrows in FIG. 4 correspond to each other. They are separated by 3.5 seconds and these 3.5 seconds is the time necessary for the cooling water to flow through the condenser tube 6. Since the length of the condenser tube 6 is known the flow velocity can be calculated in this way.

The re-identification, i.e. the matching of a sufficiently distinctive temperature profile is carried out with the aid of a cross-correlation. Such a measuring method is well-known to those skilled in the art, e.g., as disclosed in the article by N. A. Anstey entitled "Correlation Techniques—A Review", *Journal of the Canadian Society of Exploration Geophysicists*, Volume 2, Copy 1, December 1966.

The knowledge of the flow velocity can be used twice. It has already been explained that during the measuring of the absolute temperature at the tube entrance and the tube exit, additionally to the flow velocity via the sufficiently distinctive temperature profile, the transferred heat, which is taken up by the cooling water during one passage through the condenser tube 6, can be computed. With knowledge of the steam temperature, the heat transfer from the steam into the cooling water can also be computed so that the heat transfer coefficient k, which gives information as to the cleanliness of the condenser tube 6, can be computed. The steam temperature can easily be measured by blocking an adjacent condenser tube 6 into which a temperature measuring unit is then introduced. The blocking of one condenser tube 6 is insignificant to the effectiveness of a steam condenser when it is borne in mind that there are, for instance, ten thousand tubes within the total condenser. Of course, the steam temperature can be measured directly with the aid of temperature sensors or can be computed by measuring the steam pressure in the steam section of the condenser 1 when appropriate arrangements are provided.

The pressure drop between the tube entrance and the tube exit can be determined very easily. On the base of the pressure drop and the flow velocity the friction coefficient of the tube can be computed. This coefficient provides information as to the roughness of the surface and thus of the presence and kind of deposits. If for instance lime deposits grow within the condenser tubes 6 the friction coefficient of the tube initially rises strongly which is noticeable in the way described. Under the same differential pressure between the inlet and the outlet at the condenser 1 the flow velocity markedly decreases so that the increased friction coefficient of the surface is noticed immediately. By increasing the number of circulating cleaning bodies or by feeding in special cleaning bodies which might even be coated by corundum an immediate counter-measure can be initiated. In this way very good information of the state of the single condenser tube 6 and of the effectiveness of the cleaning bodies is achieved even though there is only a pressure difference measuring unit and there are only two thermo-elements per condenser tube 6 to be monitored.

Zones of different temperatures in the cooling water inlet manifold 2 (FIG. 1) of the first pass of a condenser 1, or in a one-pass condenser, can of course be created artificially by mixing heated or cooled materials into the cooling water. For instance, at a predetermined position, which is decisive for the tube to be measured, or for several tubes to be measured, steam, can be blown in or cooled or heated water may be injected. There are especially several possibilities to use heated water since this is at hand at the exit of the heat exchanger. It has been found that with these means sufficiently distinctive temperature variations can be created so that similar conditions prevail as if the cooling water had already crossed the first way of a multi-way steam condenser.

In FIG. 1 several examples are shown which can be used for creating sufficiently distinctive temperature variations immediately before the entrance of the condenser tube 6 in the cooling water inlet 2, which is fitted on both ends with a measuring device 10. One of the possibilities is a bypass conduit 24 which takes the heated cooling water behind the retainer 7 and feeds it with the aid of a pressure increase by a pump into the cooling water inlet 1. Or a heat transfer conduit 25 can take cooling water from the cooling water inlet manifold 2, pressurised with the aid of the pump 8, convey it in tight contact with the tube plate 12 on this side of the condenser 1 and finally discharge it at an appropriate place into the cooling water. In the section of the close contact with the tube plate 12 the cooling water within the heat exchanger conduit 25 takes up a higher temperature, because, due to the wetting of the tube plate 12 of the inner side with steam, a higher temperature prevails here than in the remaining areas of the cooling water inlet manifold 2. Of course, additionally or alternatively there may be a heat exchanger outwardly of the water inlet manifold which is heated by steam or with other heat or energy which is there to use.

Instead of a heat exchanger conduit 25 in the immediate vicinity to the tube plate 12 it can be sufficient to position a stream former or the like made of a sheet of metal (not shown) so that there is a flow between the former and the tube plate 12, which may be supported, if necessary, by the forming of an inlet and an outlet in support of an automatic flow without the use of a pump. When the outlet is arranged in the immediate vicinity of the entrance of a condenser tube 6 the required temperature variations are created at this place. Generally, in the cooling water inlet manifold 2 of a condenser 1 there are sufficiently big pressure variations to create such an automatic flow.

Instead of a heat exchanger, a boiler 27 may also be provided in a boiler conduit 26 with which, again with the aid of a pump 8, a pressure increase of cooling water takes place, which water is taken from the section behind the filter 4 of the cooling water inlet manifold 2, and which is warmed in the boiler 27. Of course, a boiler 27 can be placed in the bypass conduit 24 or into the heat exchanger conduit 25, if necessary. It is only important that the necessary equipment is kept small and that the energy needed for the heating, or the supply of heated or cooled streams, is not too big. An arrangement is to be preferred in which from small cross-sections of conduits a small amount of heated water is periodically used close to the entrance of the condenser tube 6 of interest. Since there is a strong cooling effect within the cooling water inlet 2 compared to the warmed water the conduits directing the warm water should have an insulation which is indicated by dotted lines in FIG. 1.

A further possibility to feed warm water into the cooling water inlet 2 is to connect two adjacent condenser tubes with the aid of a bow 28 and to position a pump 29 anywhere along the length of this unit. For the maintaining of a stream of warm water out of one of the two connected tubes a pump of very low performance is sufficient since only a very small pressure difference is necessary. It is even possible to use pressure differences or hydraulic-dynamic effects on the tube plate or within the water inlet or water outlet as a driving force.

The invention in its entirety allows the build-up of a modular system for operating a condenser 1 with a good effectiveness. In the simplest state the cleaning effectiveness of the cleaning bodies 20 is determined with the aid of the measuring device 10 at several exits of the condenser tubes 6 and computed by corresponding equipment for processing and indicating. If the arrangement is mounted to the second pass of a condenser the heat transfer between the steam and the cooling water can be measured if the same measuring devices 20 are also fitted to the entrances of the condenser tubes and if there is added to the processing equipment a unit which allows a cross-correlation for computing the time needed for the cooling water to pass a condenser tube 6 by the comparison of two temperature profiles at the entrance and at the exit of the respective condenser tube and thus for computing the cooling water flow velocity. Of course, there must be the possibility to measure the steam temperature. In one-pass condensers, or in the first pass of a multi-pass condenser, the explained devices for generating a sufficiently distinctive temperature profile has to be used.

Finally, the friction resistance of the condenser tubes can be calculated by the additiional provision of a differential pressure measuring unit for obtaining the pressure drop over the tube bunch. In this way the state of the water side tube surface can be judged thus giving in total the biggest amount of information during the operation of a condenser 1. In any case only simple devices are used which only require a small amount of fitting. Especially the fittings into the conduits filled with water are small and are provided by small components and some conduits. By multiplying the measuring points a check of the cleaning body distribution is possible. Further there is a highly redundant control system in which the failure of one or more measuring points can be tolerated up to the next servicing without a compromise in quality.

I claim:

1. A method of operating a heat exchanger comprising a bunch of heat exchange tubes extending from an inlet manifold to an outlet manifold, the method comprising passing water through said tubes from said inlet manifold to said outlet manifold and feeding cleaning bodies into said intake manifold whereby said bodies are forced by water flow through said tubes for cleaning said tubes, said cleaning bodies being recirculated from said outlet manifold via a lock back to said inlet manifold; and monitoring the cleaning effectiveness of said bodies by passing one of said cleaning bodies through a measuring tube containing water, contacting said measuring tube externally with a heat source whereby water in said measuring tube is warmed, and measuring and processing the sequence of local temperature changes when a cleaning body passes a predetermined position along said measuring tube.

2. A method according to claim 1, in which said measuring tube is one of said bunch of heat exchange tubes.

3. A method according to claim 1, wherein the said temperature change sequence is measured at the end of said measuring tube.

4. A method according to claim 2, wherein said temperature change sequence is measured on several of said heat exchange tubes.

5. A method according to claim 3, wherein said temperature change sequence is measured over a period of time, at both ends of said measuring tube and by a correlation analysis a time difference between a sufficiently distinctive temperature change profile at said tube entrance and the re-appearing at said tube exit is obtained and used for calculating the flow velocity of said water by taking into account the length of said tube.

6. A method according to claim 5, in which said sufficiently distinctive temperature change profile in the cooling water inlet is generated by local heating or cooling of said water.

7. A method according to claim 6, wherein said cooling water is warmed by back feeding of water warmed within said heat exchanger into the area of said cooling water inlet manifold.

8. A method according to claim 7, wherein a conduit for feeding said cleaning bodies is used for said feedback of warmed water.

9. A method according to claim 7, wherein flow within one of said heat exchange tubes is reversed adjacent to said measuring tube.

10. A method according to claim 6, wherein said water is warmed by blowing steam into said cooling water inlet manifold.

11. A method according to claim 6, wherein said water is warmed by feeding in warm water from a boiler.

12. A method according to claim 6, wherein said water is warmed by a heat exchange device.

13. A method according to claim 12, wherein a plate at inlet ends of said heat exchange tubes is used as said heat exchange device.

14. A method according to claim 13, in which flow within said heat exchange device is produced by pressure differences within said cooling water inlet manifold.

15. A method according to claim 5, wherein, additionally to said flow velocity, differential pressure between said cooling water inlet manifold and said cooling water outlet manifold is measured and thus the friction coefficient of said measuring tube is calculated.

* * * * *